US010180101B1

(12) United States Patent
Park et al.

(10) Patent No.: US 10,180,101 B1
(45) Date of Patent: Jan. 15, 2019

(54) FAIL-SAFE CONTROL METHOD FOR VEHICLE COOLING SYSTEM

(71) Applicants: HYUNDAI MOTOR COMPANY, Seoul (KR); KIA Motors Corporation, Seoul (KR)

(72) Inventors: Cheol Soo Park, Suwon-si (KR); Dong Suk Chae, Seoul (KR); Jun Sik Park, Seoul (KR); Seong Kyu Park, Hwaseong-si (KR); Jea Woong Yi, Uiwang-si (KR)

(73) Assignees: HYUNDAI MOTO COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/830,833

(22) Filed: Dec. 4, 2017

(30) Foreign Application Priority Data

Oct. 18, 2017 (KR) ..... 10-2017-0134948

(51) Int. Cl.

| | |
|---|---|
| ***F01P 5/14*** | (2006.01) |
| ***F01P 11/16*** | (2006.01) |
| ***F02M 26/23*** | (2016.01) |
| ***F02M 26/30*** | (2016.01) |
| ***F02M 26/45*** | (2016.01) |
| ***F02M 26/52*** | (2016.01) |
| ***F01P 7/16*** | (2006.01) |
| *F01P 3/20* | (2006.01) |
| *F01P 5/10* | (2006.01) |

(Continued)

(52) U.S. Cl.

CPC ..... *F01P 11/16* (2013.01); *F01P 7/16* (2013.01); *F02M 26/23* (2016.02); *F02M 26/30* (2016.02); *F02M 26/45* (2016.02); *F02M 26/52* (2016.02); *F01P 3/20* (2013.01); *F01P 5/02* (2013.01); *F01P 5/10* (2013.01); *F01P 2007/146* (2013.01); *F01P 2031/00* (2013.01)

(58) Field of Classification Search

CPC ..... F01P 11/16; F01P 7/16; F01P 5/10; F01P 5/02; F01P 3/20; F01P 2031/00; F01P 2007/146; F02M 26/30; F02M 26/45; F02M 26/23; F02M 26/52; F02M 26/22; F02M 26/47; F02M 26/49

USPC ..... 123/41.05, 41.08, 41.15, 568.12, 568.16; 701/107, 108; 73/114.74, 114.68

See application file for complete search history.

(56) References Cited

U.S. PATENT DOCUMENTS 7,260,468 B2 * 8/2007 Durand ..... F02D 21/08 123/41.01
7,451,748 B2 * 11/2008 Nigoro ..... F02M 26/28 123/540

(Continued)

FOREIGN PATENT DOCUMENTS

JP 2004137981 A 5/2004

*Primary Examiner* — Hai Huynh
(74) *Attorney, Agent, or Firm* — McDonnell Boehnen Hulbert & Berghoff LLP

(57) ABSTRACT

A fail-safe control method for a vehicle cooling system, in which an engine and a vehicle can be properly operated even when a water temperature sensor malfunctions. When only one of two water temperature sensors malfunctions, control may be performed so that an engine and a vehicle can properly operate. When both the two water temperature sensors malfunction, the fail-safe function of the flow rate control valve can be enabled to entirely prevent cooling water from being overheated, thereby improving the reliability of the operation of the vehicle.

9 Claims, 9 Drawing Sheets

(51) Int. Cl.
*F01P 7/14* (2006.01)
*F01P 5/02* (2006.01)

(56) References Cited

U.S. PATENT DOCUMENTS

| | | | | |
|---|---|---|---|---|
| 8,056,544 | B2 * | 11/2011 | Webb | F02M 26/33 123/568.12 |
| 9,062,635 | B2 * | 6/2015 | Chi | F02D 41/0072 |
| 9,146,176 | B2 * | 9/2015 | Nishi | F01P 11/16 |
| 9,212,630 | B2 * | 12/2015 | Peters | F02D 41/0055 |
| 9,828,902 | B2 * | 11/2017 | Uto | F01P 5/12 |
| 2004/0182373 | A1 * | 9/2004 | Li | F02M 26/49 123/568.12 |
| 2008/0271721 | A1 * | 11/2008 | Wikstrom | F02B 29/0425 123/568.12 |
| 2013/0213600 | A1 * | 8/2013 | Saitoh | F01P 7/165 165/11.1 |
| 2013/0333673 | A1 * | 12/2013 | Frick | F02M 31/04 123/557 |

* cited by examiner

FAIL-SAFE CONTROL METHOD FOR VEHICLE COOLING SYSTEM

CROSS REFERENCE TO RELATED APPLICATION

The present application claims priority to Korean Patent Application No. 10-2017-0134948, filed Oct. 18, 2017, the entire contents of which is fully incorporated by reference herein.

BACKGROUND

Field

The present disclosure generally relates to a fail-safe control method for a vehicle cooling system, in which an engine and a vehicle can be properly operated even when a water temperature sensor malfunctions.

Description of the Related Art

A cooling system using a mechanical wax-type thermostat measures the temperature of cooling water using a single water temperature sensor provided on an engine outlet side, and controls an engine and a cooling fan based thereon.

In such a cooling system, the temperature of cooling water cannot be obtained when the water temperature sensor malfunctions. Thus, a limp-home function of reducing the torque of the engine and maximizing the operation of the cooling fan is implemented to prevent secondary safety problems due to the overheating of a vehicle and damage to the engine.

However, when the water temperature sensor malfunctions, the power of the engine is immediately restricted, and the cooling fan is started even when the thermostat properly functions. This may improperly restrict the operating performance of a vehicle, which is problematic.

The foregoing is intended merely to aid in the understanding of the background of the present invention, and is not intended to mean that the present disclosure falls within the purview of the related art that is already known to those skilled in the art.

SUMMARY

Accordingly, the present application has been made with the above problems in mind, and is intended to provide a fail-safe control method for a vehicle cooling system, in which an engine and a vehicle can be properly operated even when a water temperature sensor malfunctions.

In order to achieve the above object, according to one aspect of the present disclosure, a fail-safe method for a vehicle cooling system is provided. The method includes an inlet water temperature sensor disposed on an inlet side of an engine, and an outlet water temperature sensor disposed on an outlet side of an engine, a flow rate control valve disposed on a rear end of the outlet water temperature sensor, and an exhaust gas recirculation cooler disposed between the flow rate control valve and a water pump. The fail-safe method may further include diagnosing, by a controller, whether the inlet water temperature sensor or the outlet water temperature sensor malfunctions, when the inlet water temperature sensor or the outlet water temperature sensor is diagnosed as malfunctioning, calculating, by the controller, a temperature of cooling water to be measured by the malfunctioning water temperature sensor by compensating a temperature of cooling water measured by the properly functioning water temperature sensor with a compensation value determined based on relationships among a difference in temperature between an inlet and an outlet of the engine, determined by engine operating conditions, a vehicle speed, and an ambient temperature; and controlling, by the controller, a cooling assembly and the engine based on the temperature of cooling water measured by the properly functioning water temperature sensor and the calculated temperature of cooling water at the malfunctioning water temperature sensor.

The fail-safe method may further include, when the outlet water temperature sensor is diagnosed as malfunctioning, determining, by the controller, a target inlet water temperature by calculating the difference in temperature between the inlet and the outlet of the engine, determined by the engine operating conditions, on a boiling temperature of cooling water. The cooling assembly and the engine may be controlled based on the temperature of cooling water while the target inlet water temperature is held constant.

When a cooling fan operates, the target inlet water temperature may be determined by determining a marginal temperature depending on a time delay, in which a radiator outlet temperature is reduced at a point in time in which the cooling fan starts to operate, and subtracting the marginal temperature from the boiling temperature.

The fail-safe method may further include, when the outlet water temperature sensor is diagnosed as malfunctioning, determining a compensated reference operation water temperature by compensating a reference operation water temperature, required for operating an exhaust gas recirculation system when the outlet water temperature sensor functions properly, with a predetermined temperature value, and when the calculated temperature of cooling water at the outlet is determined to exceed a reference operation water temperature, controlling an exhaust gas recirculation system to operate.

When the exhaust gas recirculation system is controlled to operate, a target inlet water temperature may be determined by compensating the calculated temperature of cooling water at the outlet with the difference in temperature between an inlet end and an outlet end of the exhaust gas recirculation cooler.

The fail-safe method may further include, when the outlet water temperature sensor or the inlet water temperature sensor is diagnosed as malfunctioning, controlling an operation of the flow rate control valve to variably operate in a section in which a completely closed position or a completely opened position of a radiator port of the flow rate control valve is avoided.

The fail-safe method may further include, when both the outlet water temperature sensor and the inlet water temperature sensor are diagnosed as malfunctioning, controlling an operation of the flow rate control valve so that a radiator port of the flow rate control valve remains partially opened.

When both the outlet water temperature sensor and the inlet water temperature sensor are diagnosed as malfunctioning, a load of the engine may be limited to be a predetermined level of load or below while an operation of the cooling fan is maximized.

The fail-safe method may further include, when both the outlet water temperature sensor and the inlet water temperature sensor are diagnosed as malfunctioning, restricting the operation of an exhaust gas recirculation system.

According to the fail-safe method as set forth above, when only one of two water temperature sensors malfunctions, control may be performed so that an engine and a vehicle can properly operate. When both the two water temperature sensors malfunction, the fail-safe function of the flow rate control valve can be enabled to entirely preventing cooling water from being overheated, thereby improving the reliability of the operation of the vehicle.

BRIEF DESCRIPTION OF THE DRAWINGS

Exemplary aspects are illustrated in the drawings. It is intended that the embodiments and figures disclosed herein are to be considered illustrative rather than restrictive.

DETAILED DESCRIPTION

Figure 1:
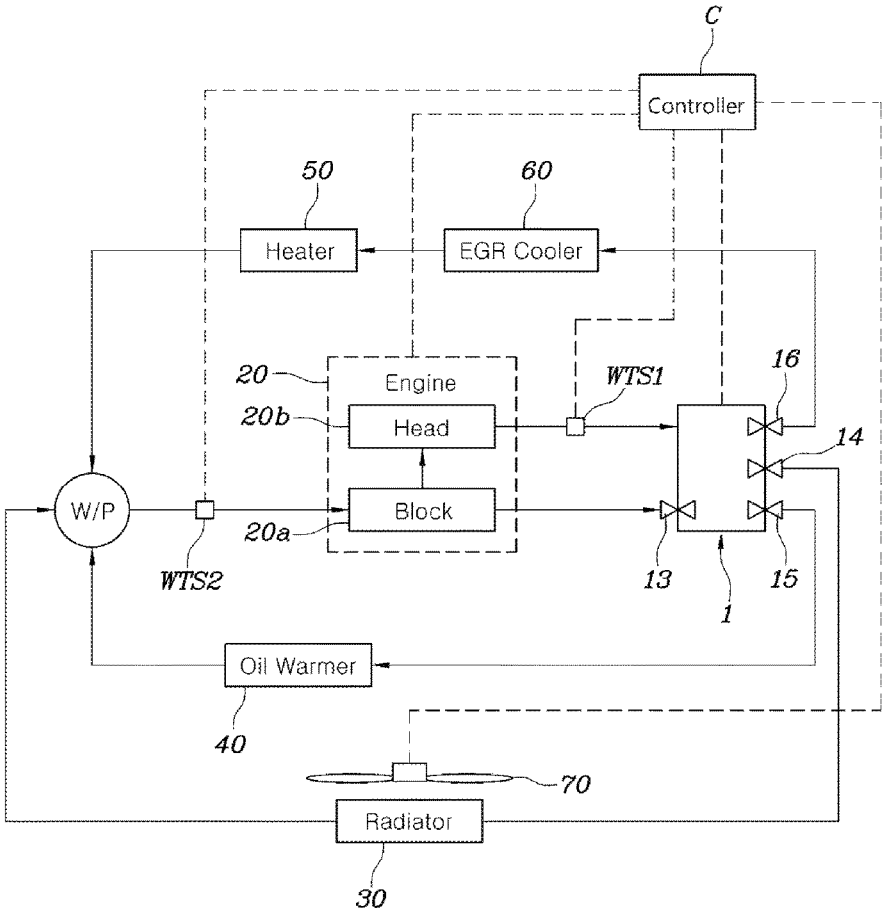
FIG. 1 is a schematic diagram illustrating a configuration of a vehicle cooling system according to an embodiment of the present application, in which an EGR cooler is disposed on a flow path on which the a heater core is disposed.

Exemplary embodiments will be described in detail with reference to the accompanying drawings. Throughout the drawings, the same reference numerals will refer to the same or like parts.

Figure 2:
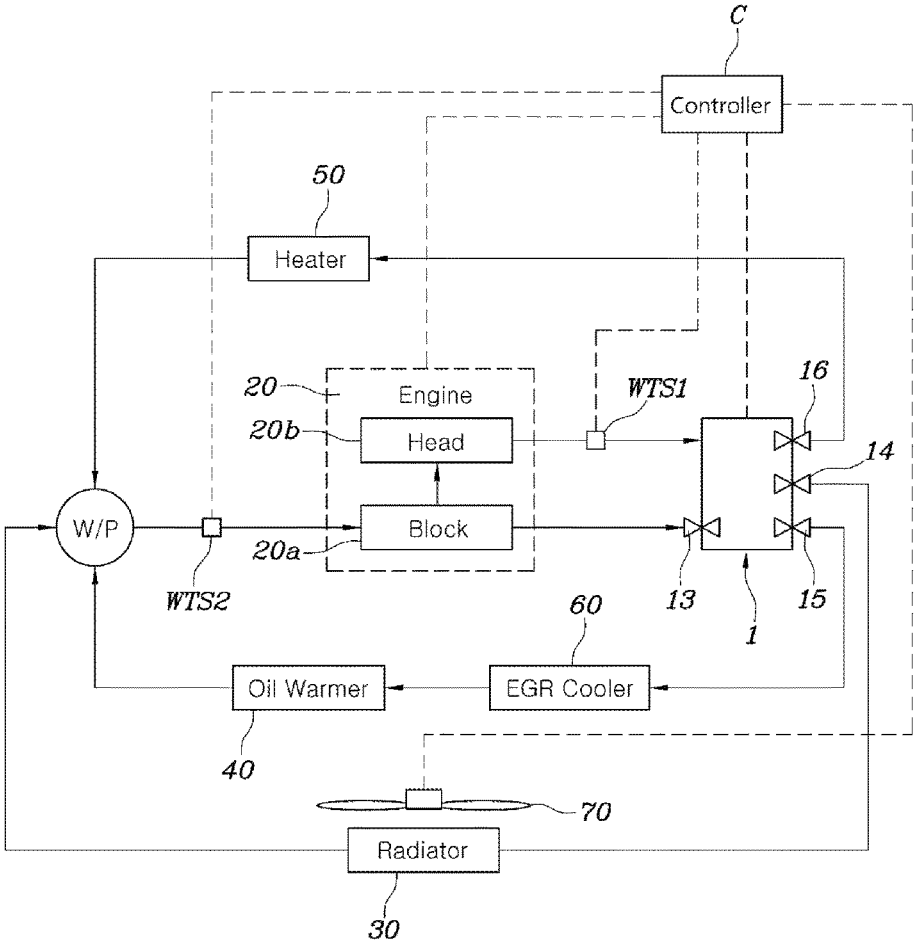
FIG. 2 is an exemplary diagram illustrating a configuration of the vehicle cooling system according to an embodiment of the present application, in which an EGR cooler is disposed on a flow path on which the an oil warmer is disposed.

FIGS. 1 and 2 schematically illustrate the configuration of a vehicle cooling system in one embodiment. Referring to FIGS. 1 and 2, an inlet water temperature sensor WTS2 is disposed on an inlet flow path of an engine, and an outlet water temperature sensor WTS1 is disposed on an outlet flow path of the engine.

In addition, a flow rate control valve 1 is disposed on the rear end of the outlet water temperature sensor WTS1. The flow rate control valve 1 provides a four-port control able to variably control four ports 13, 14, 15, and 16 at the same time by only operating a valve body provided within the valve.

For example, the flow rate control valve 1 is provided with three or more discharge ports 14, 15, and 16, each of which is connected to a flow path on which a corresponding one of a radiator 30, an oil heat exchanger such as an oil warmer 40, and a heater core 50, respectively. This configuration allows control of the flow rate of cooling water discharged to the flow path.

In particular, as illustrated in FIG. 1, an exhaust gas recirculation (EGR) cooler 60 may be arranged on a flow path on which the heater core 50 is disposed, in a flow path between the flow rate control valve 1 and a water pump W/P. Alternatively, as illustrated in FIG. 2, the EGR cooler 60 may be arranged on a flow path on which the oil warmer 40 is disposed, in the flow path between the flow rate control valve 1 and the water pump W/P.

A cooling water outlet of a cylinder block 20*a* of the engine 20 and a cooling water outlet of a cylinder head 20*b* of the engine 20 are independently connected to the flow rate control valve 1. In addition, a block port 13 is provided in a portion of the flow rate control valve 1 to be connected to the cooling water outlet of the cylinder block 20*a*. Due to this configuration, the flow rate of cooling water introduced to the flow rate control valve 1 can be controlled.

The fail-safe control method for a vehicle cooling system may also include a failure diagnosis step, a water temperature calculation step, and a cooling control step.

Figure 3:
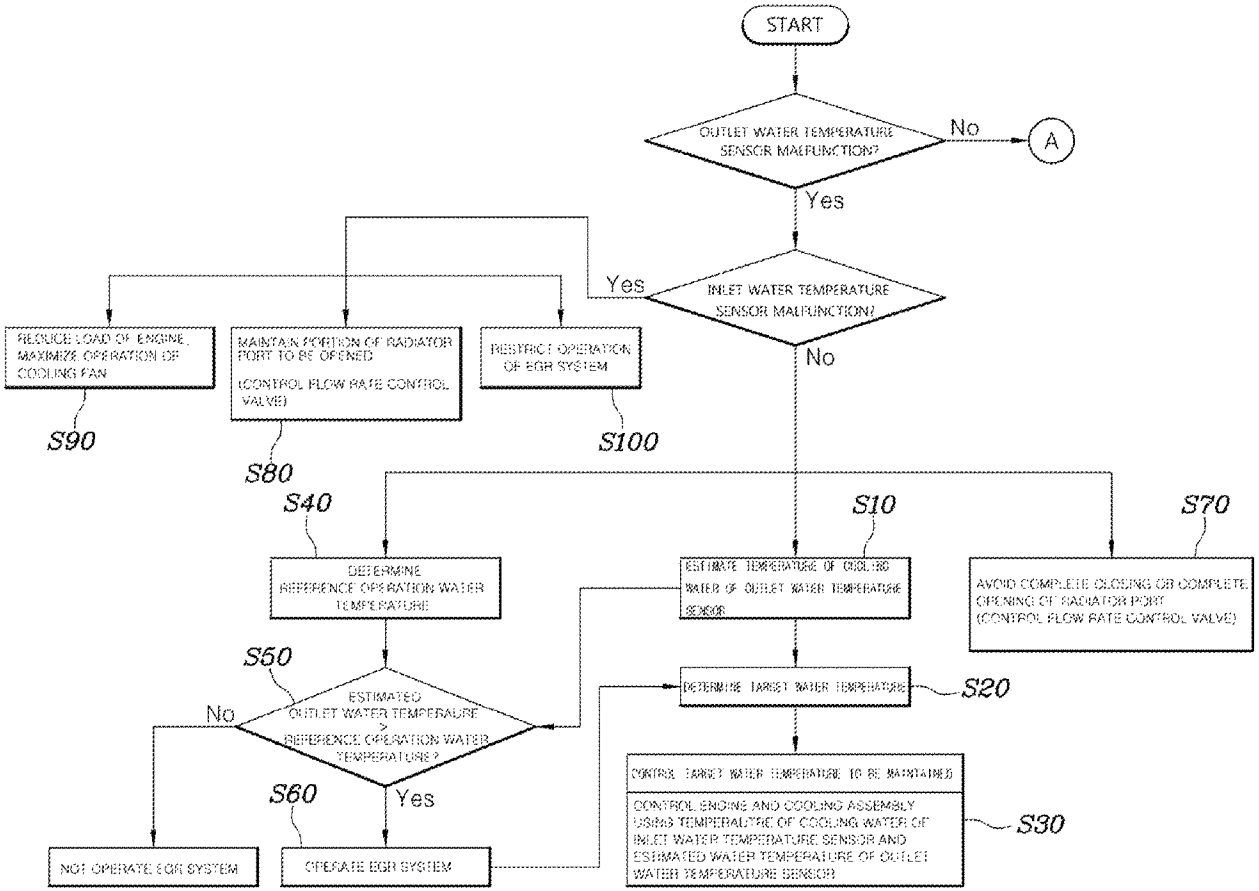
FIGS. 3 and 4 are flowcharts illustrating a fail-safe control process of the vehicle cooling system according to an embodiment of the present application.
Figure 4:
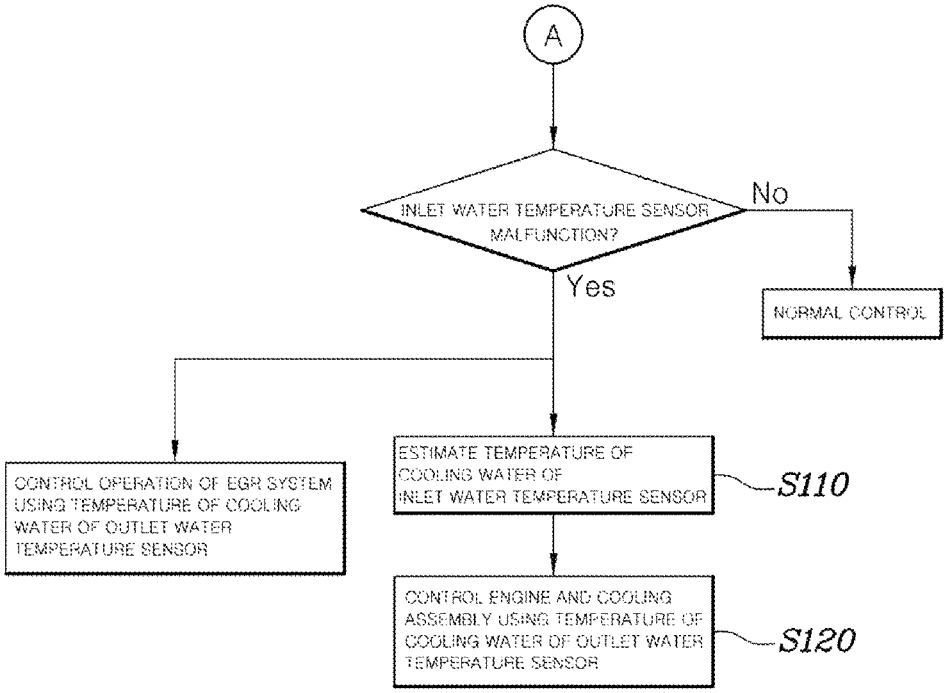
Figure 5:
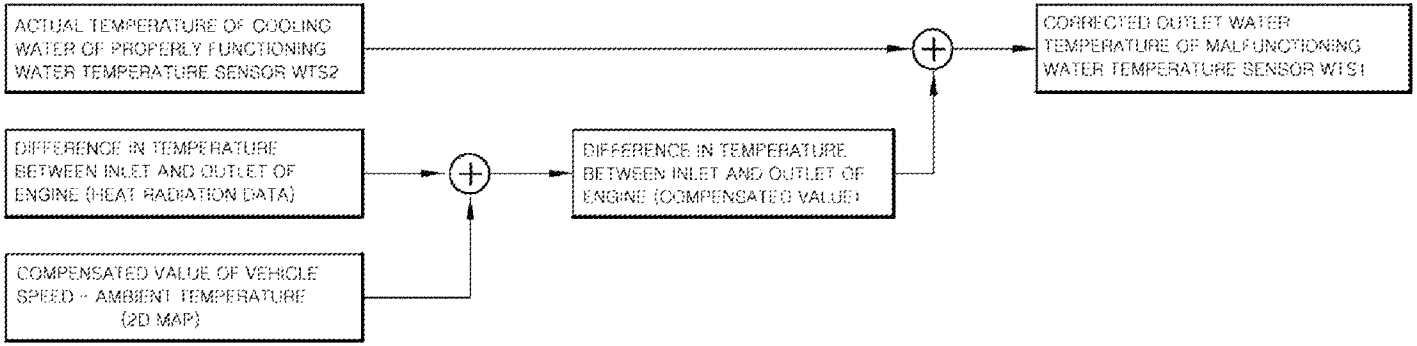
FIG. 5 is a flowchart illustrating a process of calculating a calculated temperature of cooling water at a malfunctioning water temperature sensor.

Referring to FIGS. 3 to 5, first, at the failure diagnosis step, a controller C may diagnose the inlet water temperature sensor WTS2 as malfunctioning or the outlet water temperature sensor WTS1 as malfunctioning (i.e., a fail has occurred in inlet water temperature sensor WTS2 or the outlet water temperature sensor WTS1).

In the water temperature calculation step, when the inlet water temperature sensor WTS2 or the outlet water temperature sensor WTS1 is diagnosed as malfunctioning, in S10, the controller C may calculate a temperature of cooling water to be measured by the malfunctioning water temperature sensor by compensating a temperature of cooling water measured by the properly functioning water temperature sensor with a compensation value determined based on relationships among a difference in temperature between the inlet and the outlet of the engine, determined by engine operating conditions, a vehicle speed, and an ambient temperature, for example.

In the cooling control step, the controller C may control the operation of a cooling assembly, based on the temperature of cooling water measured by the properly functioning water temperature sensor and the temperature of cooling water calculated from the temperature of cooling water to be measured by the malfunctioning water temperature sensor.

For example, when the outlet water temperature sensor WTS1 is diagnosed as malfunctioning, as illustrated in FIG. 5, the controller C may calculate a calculated outlet water temperature by compensating an inlet water temperature measured by the inlet water temperature sensor WTS2 with a disturbance compensation value determined based on relationships among a difference in temperature between the inlet and the outlet of the engine determined by the engine operating conditions, a vehicle speed, and an ambient temperature.

For example, since data regarding heat radiation from the engine can be previously acquired, the difference in temperature between the inlet and the outlet of the engine can be obtained based on the previously set heat radiation data. The disturbance compensation value can be obtained based on a two-dimensional (2D) map of the vehicle speed and the ambient temperature. Thus, the calculated outlet water temperature is calculated by the difference in temperature between the inlet and the outlet of the engine and the disturbance compensation value on the measured inlet water temperature in a compensating manner.

In this case, it is possible to control the operation of the cooling assembly and the engine, based on the inlet water temperature measured by the inlet water temperature sensor WTS2 and the calculated outlet water temperature. For example, it is possible to control the engine by controlling the operation of a cooling unit, including a cooling fan 70.

In another embodiment, when the inlet water temperature sensor WTS2 is diagnosed as malfunctioning, as illustrated in FIG. 4, in 5110, the calculated outlet water temperature may be estimated by compensating the outlet water temperature measured by the outlet water temperature sensor WTS1 with the compensation value determined based on relationships among a difference in temperature between the inlet and the outlet of the engine, determined by the engine operating conditions, a vehicle speed, and an ambient temperature.

In this case, the cooling assembly and the engine may be controlled by the outlet water temperature measured by the outlet water temperature sensor WTS1 and the calculated inlet water temperature.

When the outlet water temperature sensor WTS1 malfunctions while the inlet water temperature sensor WTS2 is functioning properly, or when the inlet water temperature sensor WTS2 malfunctions while the outlet water temperature sensor WTS1 is functioning properly, the temperature of cooling water to be measured by a malfunctioning temperature sensor is calculated based on the temperature of cooling water measured by a properly functioning temperature sensor. The temperature of cooling water in the inlet side or the outlet side of the engine, calculated as described above, may be applied as an inlet water temperature or an outlet water temperature, so that the engine and the cooling fan 70 can be properly controlled.

Thus, even in the case in which one of two water temperature sensors malfunctions, it is possible to properly operate the engine and the vehicle, thereby improving the convenience of a driver and the safety of driving.

In addition, when the outlet water temperature sensor WTS1 is diagnosed as malfunctioning, the fail-safe control method may further include a target inlet water temperature determination step S20 of determining a target inlet water temperature by calculating the difference in temperature between the inlet and the outlet of the engine, determined by the engine operating conditions, on the boiling temperature of cooling water.

In the target inlet water temperature determination step S20, when the cooling fan 70 operates, the target inlet water temperature may be determined by determining a marginal temperature depending on a time delay, in which a radiator outlet temperature is reduced at a point in time in which the cooling fan 70 starts to operate, and by subtracting the marginal temperature from the boiling temperature (i.e., boiling temperature−marginal temperature).

In this case, the cooling control step may further include step S30 of controlling the operations of the engine and the cooling assembly while the target inlet temperature is held constant.

When the outlet water temperature sensor WTS1 malfunctions, even if the outlet temperature of the engine is calculated, the calculated outlet temperature is not an actual outlet temperature, and the inlet control temperature of the engine must be held constant.

For example, in a condition in which a pressing system of the vehicle cooling assembly does not operate, the boiling temperature of cooling water having an antifreezing solution to water ratio of 50:50 ranges from about 107° C. to about 109° C. When the boiling temperature is 108° C., the highest inlet/outlet temperature of the engine is typically about 10° C. Thus, the target inlet control temperature for reliable control is about 98° C. or below.

In contrast, when the cooling fan 70 operates due to degradations in the heating performance of the radiator 30, a marginal temperature of about 3° C. may be considered due to a time delay in which the outlet temperature of the radiator 30 is reduced from the point in time in which the cooling fan 70 starts to operate. In this case, the target inlet control temperature is about 95° C. or below. Thus, the target inlet temperature may be set to a range from about 80° C. to about 95° C. for the heat efficiency and normal combustion of the engine.

In another embodiment, referring to FIG. 4, when the inlet water temperature sensor WTS2 is diagnosed as malfunctioning, in 5120, control is performed based on the temperature of cooling water measured by the outlet water temperature sensor WTS1.

When the inlet water temperature sensor WTS2 properly functions, feedback control is performed by comparing a compensated inlet cooling water temperature, compensated based on the difference between an actual temperature of cooling water measured by the outlet water temperature sensor WTS1 and the target outlet cooling water temperature, with an actual inlet water temperature. However, when the inlet water temperature sensor WTS2 malfunctions, feedback control is performed entirely based on the temperature of cooling water measured by outlet water temperature sensor WTS1, since feedback control cannot be performed by comparing the actually measured temperature.

In this case, although temperature controllability may be sacrificed to a certain degree, the operation of the engine is not significantly influenced. It is therefore possible to prevent the temperature of the engine from excessively rising and properly operate the vehicle. In this case, it is possible to maintain cooling water controllability and improve a safety function by outlet control by lowering the target outlet water temperature of the engine to a certain degree. The target outlet water temperature may suitably range from 90° C. to 100° C.

Figure 6:
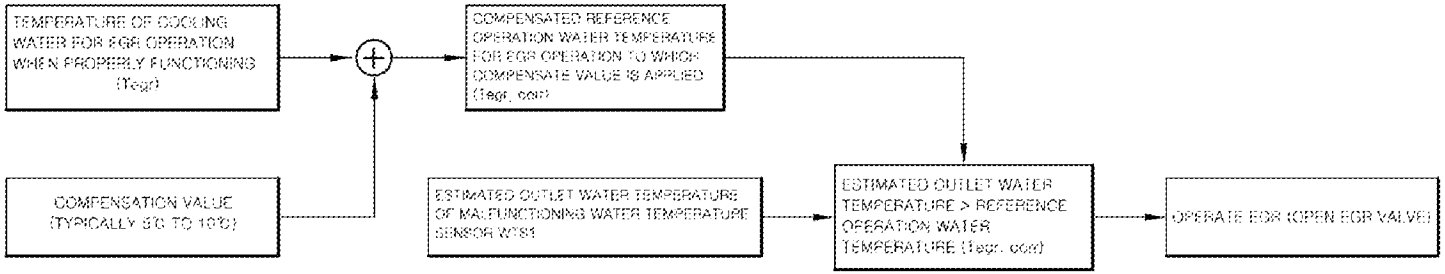
FIG. 6 is a flowchart illustrating a process of controlling the operation of an EGR system according to an embodiment of the present application.

Referring to FIGS. 3 and 6, when the outlet water temperature sensor WTS1 is diagnosed as malfunctioning as a result of the failure diagnosis step, the fail-safe control method may further include a compensated reference operation water temperature determination step S40 of determining a compensated reference operation water temperature by compensating a reference operation water temperature, required for operating an exhaust gas recirculation (EGR) system when the outlet water temperature sensor WTS1 functions properly, with a predetermined temperature value. Additionally, the fail-safe control method may include a step S50 of determining whether or not the calculated outlet water temperature, calculated for the outlet water temperature sensor WTS1 diagnosed as malfunctioning, exceeds the reference operation water temperature. In some embodiments, the fail-safe control method may also include an EGR operation step S60 of controlling the EGR system to operate when the calculated outlet water temperature is determined to exceed the reference operation water temperature.

For example, when the outlet water temperature sensor WTS1 functions properly, the operation of the EGR system is controlled using the temperature measured by the outlet water temperature sensor WTS1. However, when the outlet water temperature sensor WTS1 malfunctions, the temperature measured thereby cannot be used as is. In this regard, the reference operation water temperature is determined by adding a predetermined safety temperature value (e.g. 5° C. to 10° C.) to a temperature value previously set depending on the requirements of the operation of the EGR system in the state in which the outlet water temperature sensor WTS1 functions properly.

However, when the calculated outlet water temperature is compared with and is determined to be higher than the reference operation water temperature, the EGR system may be operated instead of being controlled using the above-determined reference operation water temperature.

In addition, when the EGR system is operated in the EGR operation step S60, in S20, the target inlet water temperature may be determined by compensating the calculated outlet water temperature with the difference in temperature between the inlet end and the outlet end of the EGR cooler 60.

For example, when the EGR cooler 60 operates following the operation of the EGR system, the difference in temperature between the inlet end and the outlet end of the EGR cooler 60 is about 2° C. to about 6° C. In a case in which the target inlet water temperature is supposed to be about 95° C. when the EGR cooler 60 does not operate and in which the difference in temperature between the inlet end and the outlet end of the EGR cooler 60 is about 6° C., the target inlet water temperature when the EGR cooler 60 operates is controlled to be about 89° C. (=95° C.-6° C.). That is, it is possible to obtain the functional stability of the cooling assembly by controlling the target inlet water temperature when the EGR cooler 60 operates to be lower than a target inlet water temperature when the EGR cooler 60 does not operate.

Figure 7:
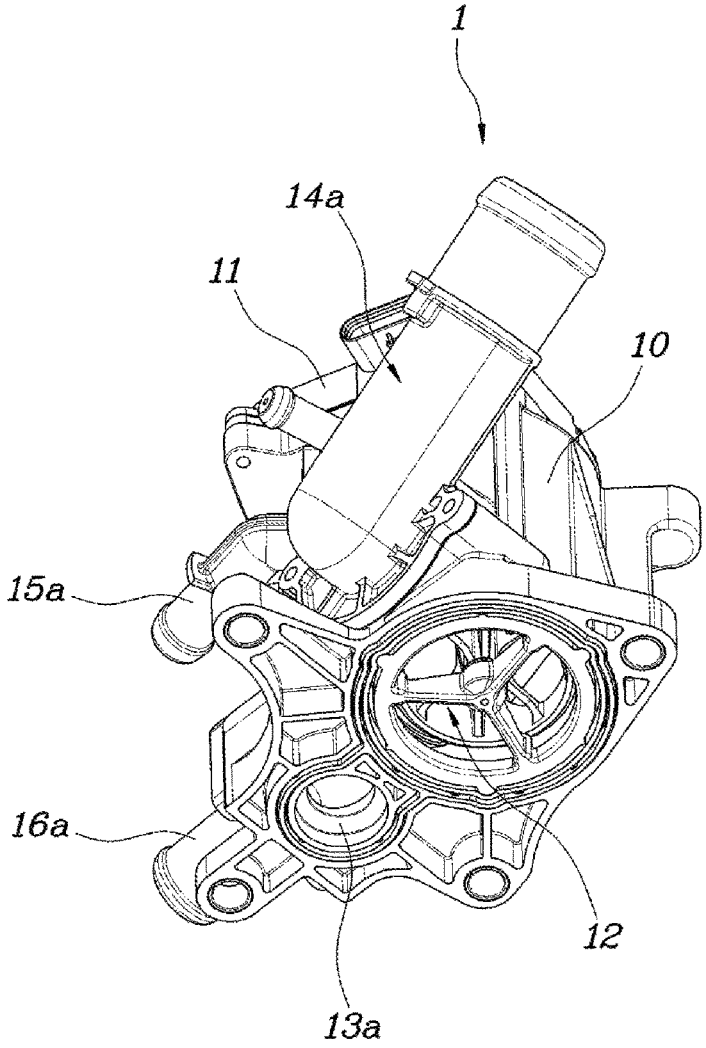
FIG. 7 is a perspective view illustrating a flow rate control valve according to an embodiment of the present application.
Figure 8:
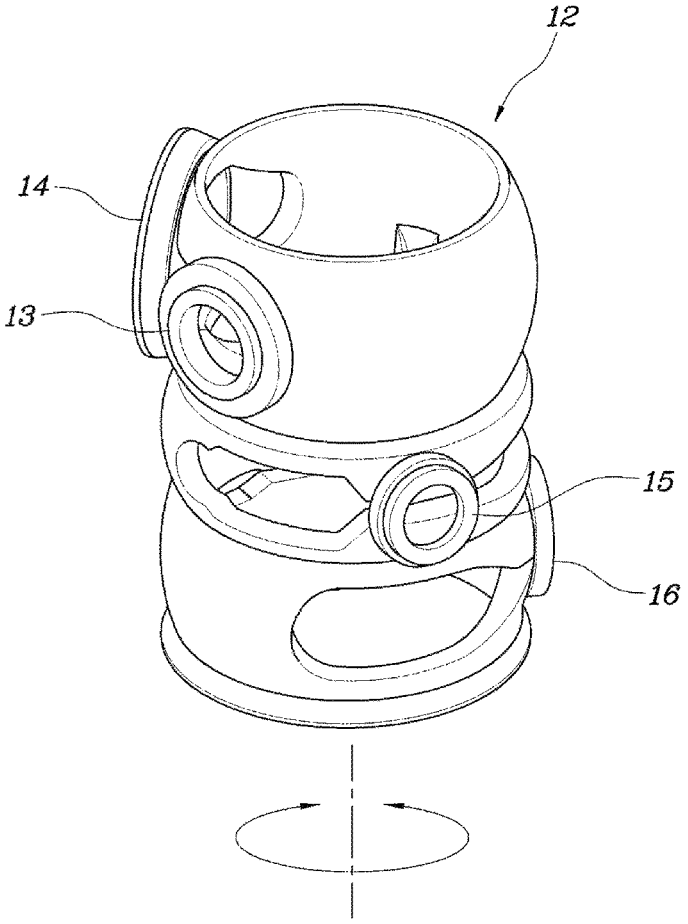
FIG. 8 is a perspective view illustrating the valve body of the flow rate control valve, illustrated in FIG. 7, the valve body having an arrangement of ports.

FIGS. 7 and 8 illustrate an example flow rate control valve 1 including a valve housing 10, a driving unit 11, and a valve body 12.

Referring to FIGS. 7 and 8, the valve housing 10 is configured to take in cooling water discharged from the engine 20 and to discharge the taken-in cooling water. In this regard, the valve housing 10 includes a block port 13, a radiator port 14, an oil heat exchanger port 15, and a heater core port 16.

Specifically, for example, the block port 13 is connected to a cooling water outlet of the cylinder block 20*a*. The radiator port 14 is connected to a flow path on which the radiator 30 is disposed. The oil heat exchanger port 15 is connected to a flow path on which the oil warmer 40 is disposed. The heater core port 16 is connected to a flow path on which the heater core 50 is disposed.

For reference, reference numeral 13*a* in FIG. 7 indicates a conduit connected to the radiator port 14, reference numeral 15*a* indicates a conduit connected to the oil heat exchanger port 15, and reference numeral 16*a* indicates a conduit connected to the heater core port 16.

The driving unit 11 is mounted on the top portion of the valve housing 10 to produce a torque. The driving unit 11 may be, for example, a motor.

The valve body 12 is disposed within the valve housing 10. The valve body 12 rotates within a predetermined angle range due to rotational force provided by the driving unit 11.

The valve body 12 may take the shape of a hollow cylinder, and may selectively communicate with the block port 13, the radiator port 14, and the oil heat exchanger port 15 with changes in the angle of rotation of the valve body 12.

That is, the degrees of opening of the ports are adjusted following the rotation of the valve body 12, so that the flow rate of cooling water can be controlled.

Here, the bottom of the valve body 12 may be open and be connected to the outlet of the cylinder head 20*b*, such that cooling water discharged from the cylinder head 20*b* can be constantly introduced into the valve body 12.

Figure 9:
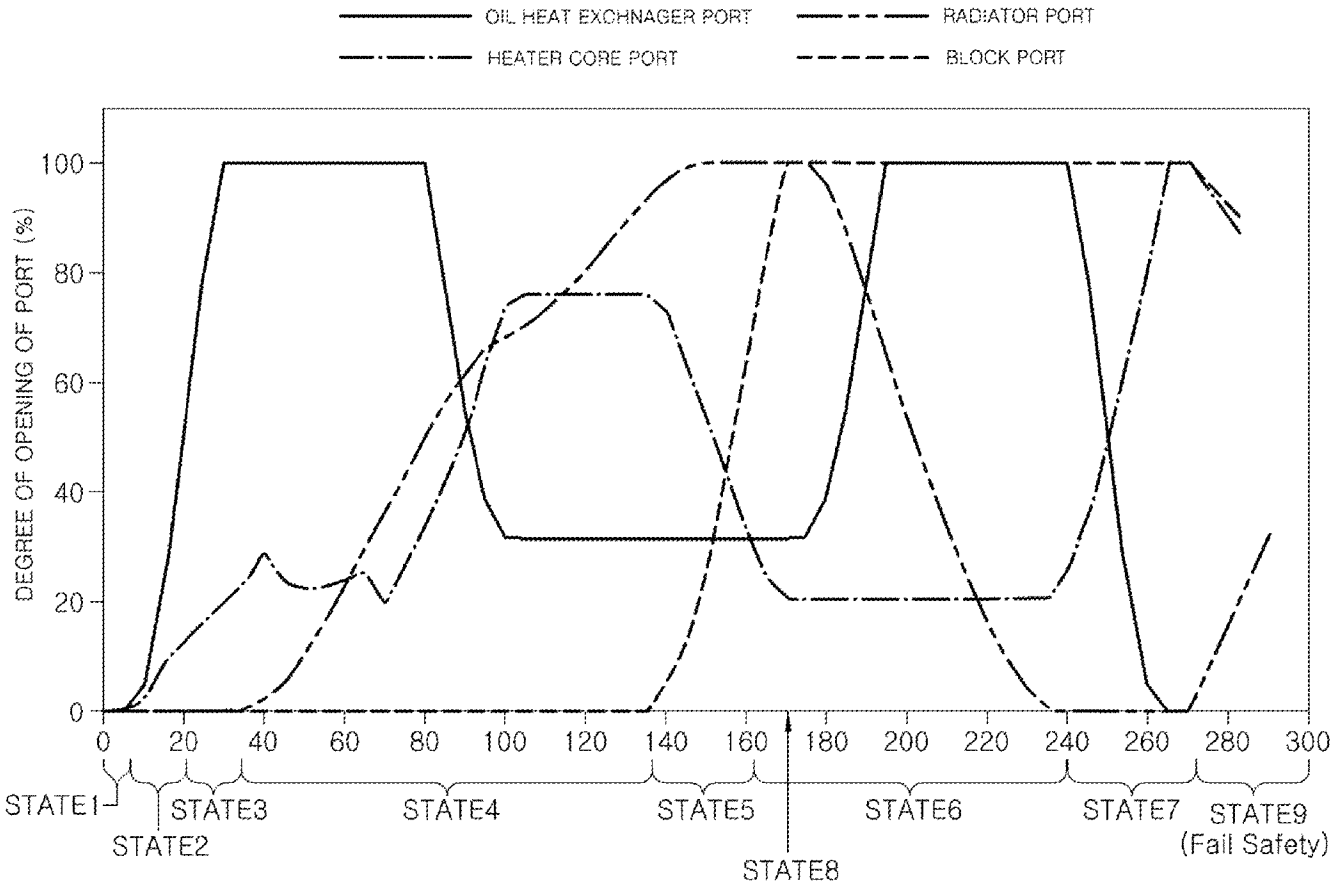
FIG. 9 is graph illustrating the flow rate control valve according to an embodiment of the present application.

FIG. 9 is graph illustrating variations in the degree of opening of each port with changes in the angle of operation of the flow rate control valve 1. In the graph, the X axis indicates entire angles of rotation of the valve (sections between the left end and the right end), and the Y axis indicates the degrees of opening of each port.

Since the angles of rotation of the flow rate control valve 1 may vary within a predetermined angle range, when the angle of operation is changed within the range of the entire angles of rotation, depending on the driving conditions of the vehicle, the degrees of opening of the radiator port 14, the oil heat exchanger port 15, the heater core port 16, and the block port 13 are varied with changes in the angles.

In addition, a scheme of separately cooling the cylinder head 20*b* and the cylinder block 20*a* may be applied or canceled as the block port 13 is opened or closed following the operation of the flow rate control valve 1. Furthermore, since the degrees of opening of the radiator port 14, the oil heat exchanger port 15, and the heater core port 16 are simultaneously controlled, four-port control of variably controlling four ports at the same time by the operation of the flow rate control valve 1 is possible.

Referring to FIG. 3 together with FIG. 9, the fail-safe control method may further include, when the outlet water temperature sensor WTS1 or the inlet water temperature sensor WTS2 is diagnosed as malfunctioning, a first valve control step of controlling the operation of the flow rate control valve 1 to variably operate in a section in which a completed closed position or a completely opened position of the radiator port 14 of the flow rate control valve 1 is avoided.

Specifically, when a failure has occurred in one of the two water temperature sensors, the temperature of the engine may not be accurately determined, although the temperature may be estimated. In this regard, in S70, to reliably realize the fail-safe function, a flow of cooling water may be controlled by operating the flow rate control valve 1 to be converted to STATE4 section or the STATE6 section while skipping STATE1 section (flow stop control section) and STATE2 section (heat exchanger control section).

In addition, the fail-safe control method may further include, when both the outlet water temperature sensor WTS1 and the inlet water temperature sensor WTS2 are diagnosed as malfunctioning, a second valve control step of controlling the operation of the flow rate control valve 1 so that the radiator port 14 of the flow rate control valve 1 remains partially opened.

For example, when both the water temperature sensors malfunction, in S80, it is considered that a problem has occurred in the cooling assembly and the flow rate control valve 1 is converted to STATE9 section so that the radiator port 14 constantly remains opened, thereby preventing the temperature of cooling water from rising excessively.

That is, unlike a conventional mechanical thermostat, it is possible to forcibly convert the flow rate control valve 1 into an opened position, thereby minimizing damage to the engine. This can consequently realize a significant level of stability and a limp-home function, thereby preventing overheating.

In addition, referring to FIG. 3, when both the outlet water temperature sensor WTS1 and the inlet water temperature sensor WTS2 are diagnosed as malfunctioning, the load of the engine may be limited to be a predetermined level of load or below while the operation of the cooling fan 70 may be maximized.

That is, in S90, the load of the engine is limited to be a predetermined level or below and the operation of the cooling fan 70 is maximized to prevent the temperature of cooling water excessively rising, so that the engine can operate to a minimum level.

Furthermore, the fail-safe control method may further include, when both the outlet water temperature sensor WTS1 and the inlet water temperature sensor WTS2 are diagnosed as malfunctioning, an EGR operation restriction step of restricting the operation of the EGR system.

In 5100, the EGR system is controlled not to operate, since the engine may be damaged due to boiling within the EGR cooler 60, and the EGR cooler 60 may rust due to the condensation of water within the EGR cooler 60 when the EGR is operated in the case in which both the water temperature sensors are malfunctioning.

As set forth above, when only one of the two water temperature sensors malfunctions, control may be performed so that the engine and the vehicle can properly operate. When both of the water temperature sensors malfunction, the fail-safe function of the flow rate control valve 1 can be prevent cooling water from being overheated, thereby improving the reliability of the operation of the vehicle.

While a number of exemplary aspects have been discussed above, those of skill in the art will recognize that still further modifications, permutations, additions and sub-combinations thereof of the disclosed features are still possible. It is therefore intended that the following appended claims and claims hereafter introduced are interpreted to include all such modifications, permutations, additions and sub-combinations as are within their true spirit and scope.

What is claimed is:

1. A fail-safe method for a vehicle cooling system comprising:

an inlet water temperature sensor disposed on an inlet side of an engine, and an outlet water temperature sensor disposed on an outlet side of an engine, a flow rate control valve disposed on a rear end of the outlet water temperature sensor, and an exhaust gas recirculation cooler disposed between the flow rate control valve and a water pump;

diagnosing, by a controller, whether the inlet water temperature sensor or the outlet water temperature sensor malfunctions;

when the inlet water temperature sensor or the outlet water temperature sensor is diagnosed as malfunctioning, calculating, by the controller, a temperature of cooling water to be measured by the malfunctioning water temperature sensor by compensating a temperature of cooling water measured by the properly functioning water temperature sensor with a compensation value determined based on relationships among a difference in temperature between an inlet and an outlet of the engine, determined by engine operating conditions, a vehicle speed, and an ambient temperature; and controlling, by the controller, a cooling assembly and the engine based on the temperature of cooling water measured by the properly functioning water temperature sensor and the calculated temperature of cooling water at the malfunctioning water temperature sensor.

2. The fail-safe method according to claim 1, further comprising, when the outlet water temperature sensor is diagnosed as malfunctioning, determining, by the controller, a target inlet water temperature by calculating the difference in temperature between the inlet and the outlet of the engine, determined by the engine operating conditions, on a boiling temperature of cooling water, wherein the cooling assembly and the engine are controlled based on the temperature of cooling water while the target inlet water temperature is held constant.

3. The fail-safe method according to claim 2, wherein, when a cooling fan operates, the target inlet water temperature is determined by determining a marginal temperature depending on a time delay, in which a radiator outlet temperature is reduced at a point in time in which the cooling fan starts to operate, and subtracting the marginal temperature from the boiling temperature.

4. The fail-safe method according to claim 1, further comprising:

when the outlet water temperature sensor is diagnosed as malfunctioning, determining a compensated reference operation water temperature by compensating a reference operation water temperature, required for operating an exhaust gas recirculation system when the outlet water temperature sensor functions properly, with a predetermined temperature value; and when the calculated temperature of cooling water at the outlet is determined to exceed a reference operation water temperature, controlling an exhaust gas recirculation system to operate.

5. The fail-safe method according to claim 4, wherein, when the exhaust gas recirculation system is controlled to operate, a target inlet water temperature is determined by compensating the calculated temperature of cooling water at the outlet with the difference in temperature between an inlet end and an outlet end of the exhaust gas recirculation cooler.

6. The fail-safe method according to claim 1, further comprising, when the outlet water temperature sensor or the inlet water temperature sensor is diagnosed as malfunctioning, controlling an operation of the flow rate control valve to variably operate in a section in which a completely closed position or a completely opened position of a radiator port of the flow rate control valve is avoided.

7. The fail-safe method according to claim 1, further comprising, when both the outlet water temperature sensor and the inlet water temperature sensor are diagnosed as malfunctioning, controlling an operation of the flow rate control valve so that a radiator port of the flow rate control valve remains partially opened.

8. The fail-safe method according to claim 7, when both the outlet water temperature sensor and the inlet water temperature sensor are diagnosed as malfunctioning, a load of the engine is limited to be a predetermined level of load or below while an operation of the cooling fan is maximized.

9. The fail-safe method according to claim 1, further comprising, when both the outlet water temperature sensor and the inlet water temperature sensor are diagnosed as malfunctioning, restricting the operation of an exhaust gas recirculation system.

* * * * *